US005836195A

United States Patent [19]

Wu

[11] Patent Number: 5,836,195

[45] Date of Patent: Nov. 17, 1998

[54] AUTOMATIC CUTTER ROTATING MECHANISM FOR WIRE FORMING MACHINE

[76] Inventor: David Wu, 1F, No. 68, Lane 280, Sec.6, Min Chuan E. Rd., Nei Hu, Taipei, Taiwan

[21] Appl. No.: 898,151

[22] Filed: Jul. 22, 1997

[51] Int. Cl.[6] ..... B21F 1/00; B21F 11/00

[52] U.S. Cl. ..... 72/338; 72/403; 72/446

[58] Field of Search ..... 72/307, 452.5, 72/446, 447, 449, 403, 338, 337, 331, 330, 324

[56] References Cited

U.S. PATENT DOCUMENTS

| | | | |
|---|---|---|---|
| 4,580,329 | 4/1986 | Bihler | 72/449 |
| 4,581,917 | 4/1986 | Morlyama | 72/446 |
| 4,643,018 | 2/1987 | Wunsch | 72/446 |
| 4,773,250 | 9/1988 | Miyazaki | 72/446 |
| 4,862,717 | 9/1989 | Dolliner | 72/403 |

*Primary Examiner*—Daniel C. Crane

*Attorney, Agent, or Firm*—Rosenberg, Klein & Bilker

[57] ABSTRACT

A type of automatic cutter rotating mechanism for wire forming machine, on the circumference of the rotating spindle of said wire forming machine is fitted with a rotating unit; said rotating unit can be driven by a first servo motor via a transmission mechanism; there is another second servo motor that will drive the rotating spindle to rotate via the transmission mechanism; on the machine body and the rotating unit are several sets of forming units; each of the forming units having a third servo motor; said third servo motor can drive a cam to rotate via the transmission mechanism; said cam has a cam groove; on the machine body is fitted with a first rail; on the first rail is a transmission unit; on the transmission unit is a first roller; the first roller is located in the cam groove of the cam; the forming unit has a second rail; said second rail is fitted on the transmission unit; on the second rail is a cutter unit; on the cutter unit is fixed a forming cutter; the cutter unit has a second roller; said second roller is located in an arched groove on the transmission unit; with such a configuration, the wire forming machine will not be restricted in its applications, and will be more convenient in operation.

3 Claims, 7 Drawing Sheets

AUTOMATIC CUTTER ROTATING MECHANISM FOR WIRE FORMING MACHINE

BACKGROUND OF THE INVENTION

The subject invention relates to a type of automatic cutter rotating mechanism for wire forming machine, particularly to one that enables more convenient operation and applications.

DESCRIPTION OF PRIOR ART

A wire forming machine is a machine that bends the wire material into desired shapes and forms, such as springs or other parts. Referring to FIGS. 1 and 2, the prior art of wire forming machine comprises several sets (8 sets) of forming units, 11*a* on the machine body 10*a;* each of said forming units 11*a* has a cam 12*a* that is driven by a servo motor (not shown in drawing), on the side of the cam 12*a* is a moving arm 13*a;* one end of the moving arm 13*a* is fitted with a roller 14*a;* the roller 14*a* is located on the working curve of the cam 12*a;* when the cam 12*a* rotates, the roller 14*a* will move up and down along the curve of the cam 12*a,* to drive the linked lever 15*a* on the other end of the moving arm 13*a;* the other end of the linked lever 15*a* is connected to a cutter unit 16*a;* on the cutter unit 16*a* is fixed with a forming cutter 17*a;* the linked lever 15*a* drives the forming cutter 17*a* to move up and down; so that the wire material delivered from the wire delivering device on the rear of the rotating spindle 18*a* is bent and formed by the forming cutter 17*a.*

However, in said prior art of wire forming machine, the forming units 11*a* will operate only within a restricted angle; in case of eight sets of forming units 11*a,* the forming cutter 17*a* will form the wire material only within a preset 45-degree angle, and will not operate the forming process at other angles; therefore, the applications of the wire forming machine are restricted, and the operation is less convenient.

SUMMARY OF THE INVENTION

The main purpose of the subject invention is to provide a type of automatic cutter rotating mechanism for wire forming machine, comprising mainly a rotating unit that will rotate freely at all angles (360 degrees) on the machine body of the wire forming machine; and the cutter unit of each forming unit is located on the rail on the rotating unit; the driving transmission unit and cutter unit of each forming unit are connected by a roller and groove; the roller can move freely within the arched groove; so that even if the transmission unit is not preset at a specified angle, the force from the transmission unit will be transmitted to the cutter unit; thus the forming unit will be able to operate the wire forming process at an angle beyond the preset angle; so the wire forming machine will be less restricted in its applications; furthermore, each set of cutter unit, forming unit and roller can be connected at random with any set of transmission unit and groove on the outside circumference, instead of one-to-one combinations; so its operation is more convenient; besides, the forming cutter of the subject invention employs a compulsory pulling back method for reset functions, so there is no worry that it will be stuck on the wire material.

The design approaches and functions employed in the subject invention to achieve the above purpose and configuration are described below in details with drawings:

Brief Description of Numerals

Figure 1:
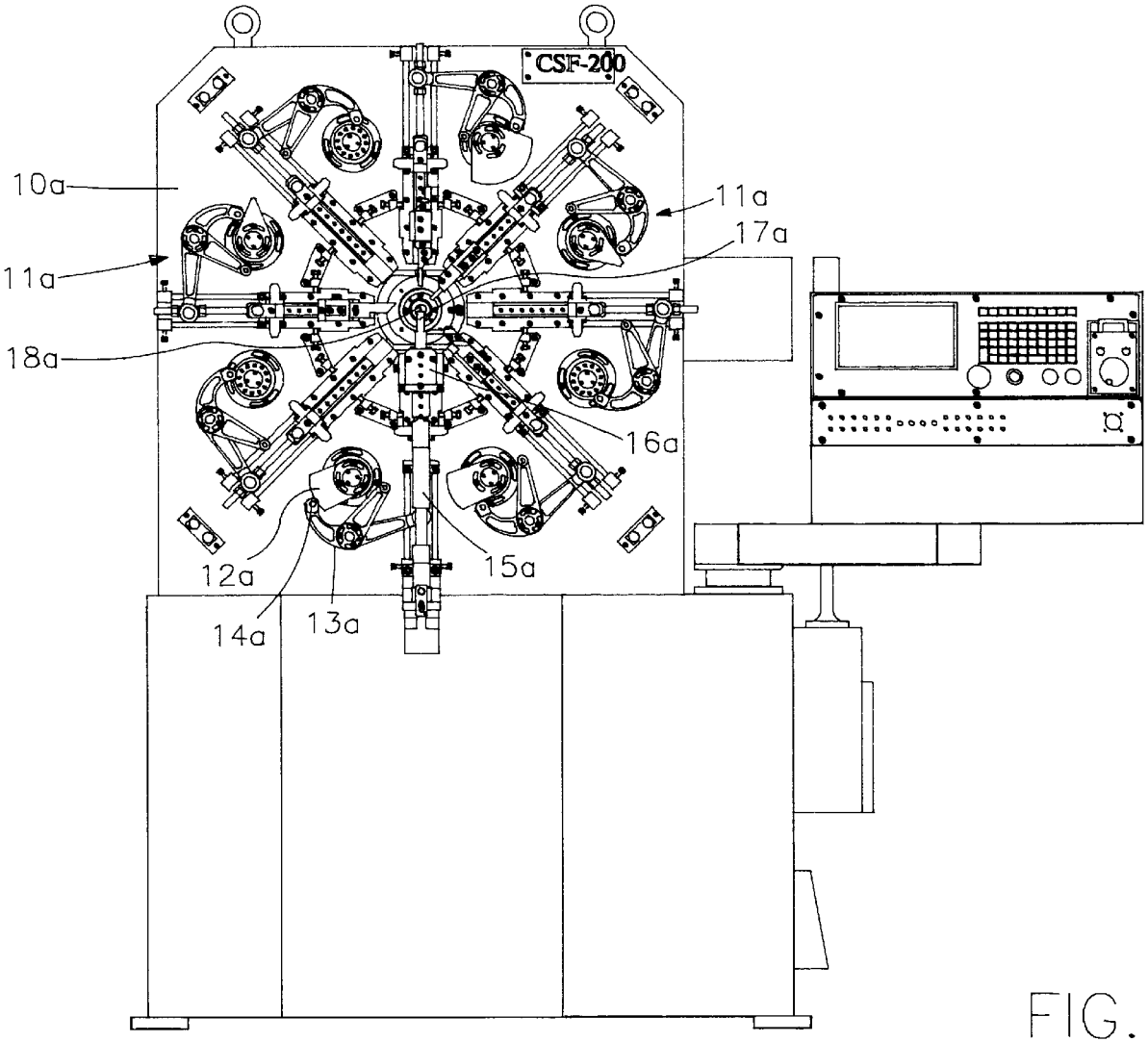
FIG. 1 is the front view of a prior art of wire forming machine.
Figure 2:
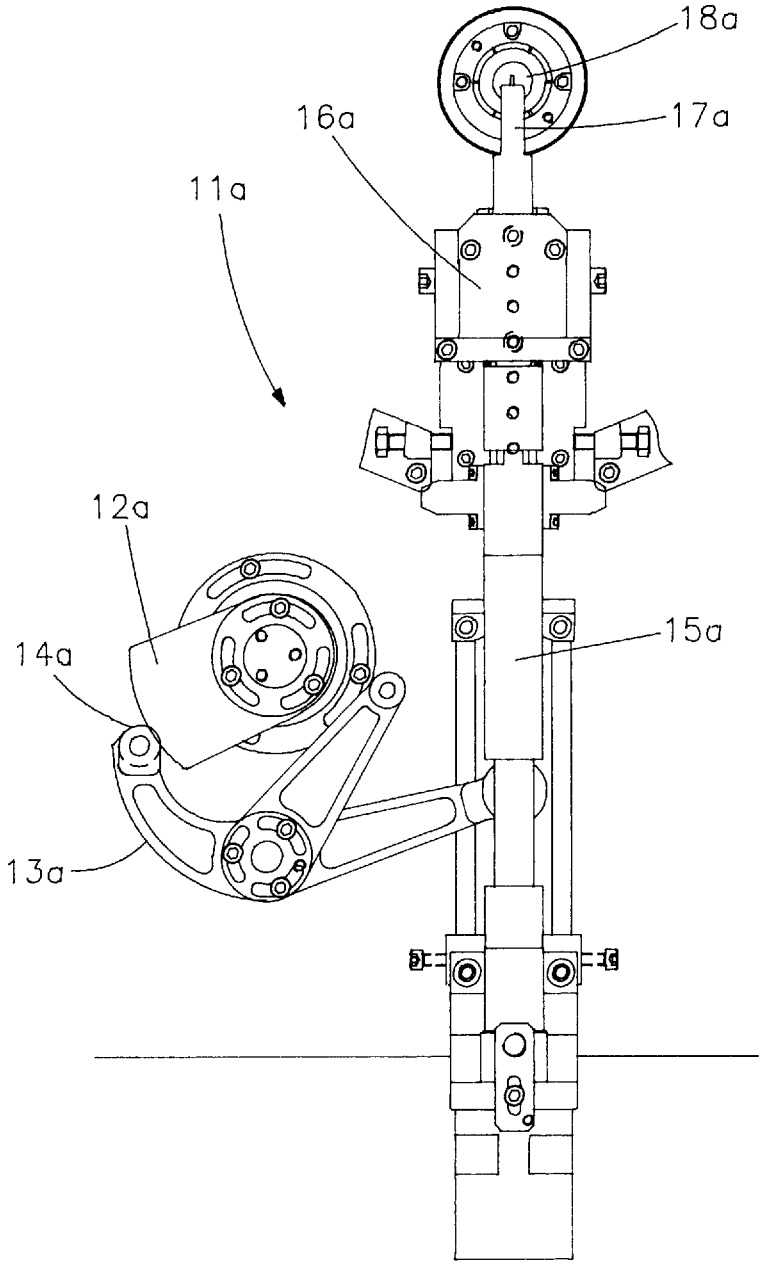
FIG. 2 is the front view of a single forming unit of a prior art of wire forming machine.
Figure 3:
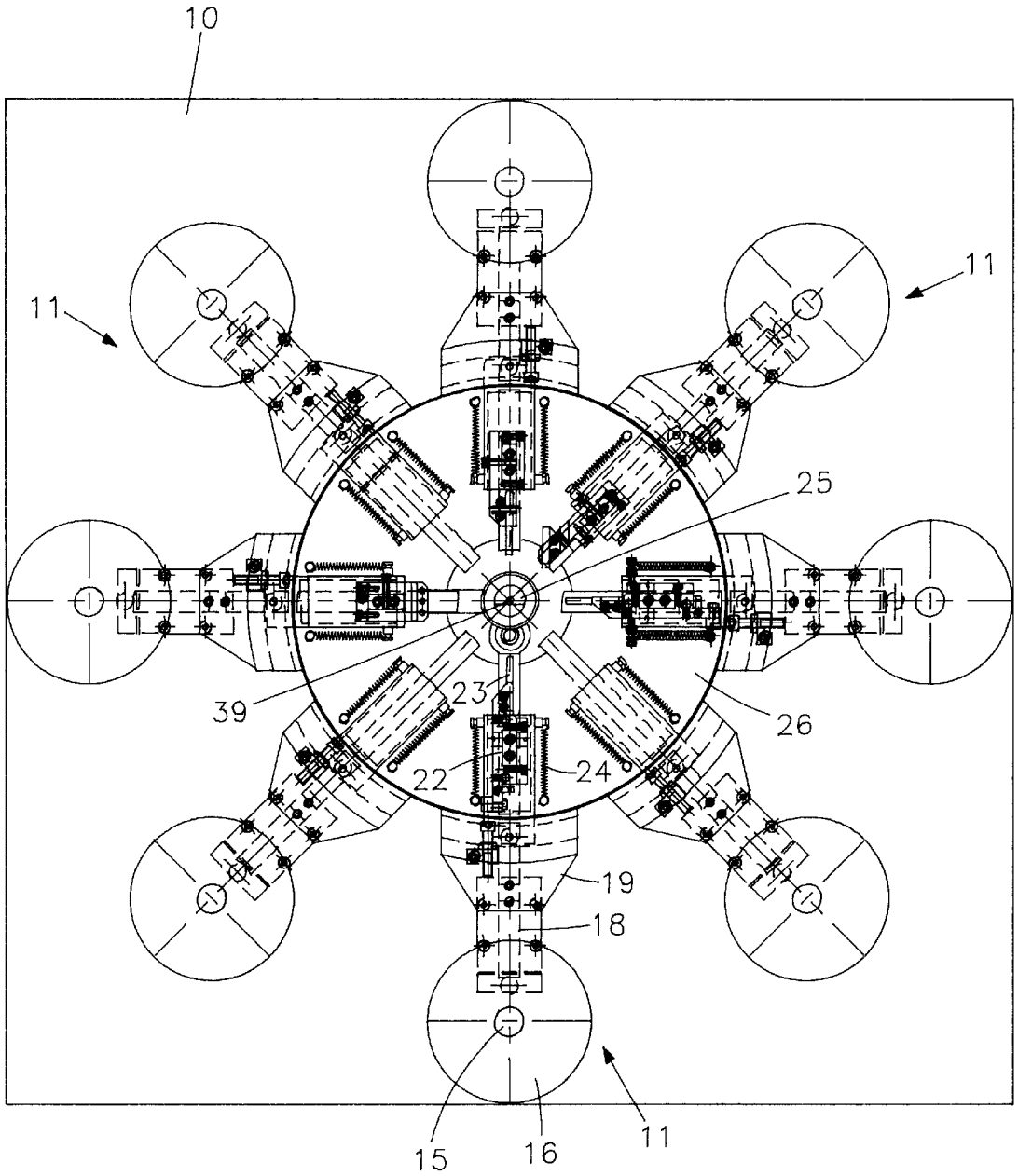
FIG. 3 is the front view of the subject invention.
Figure 4:
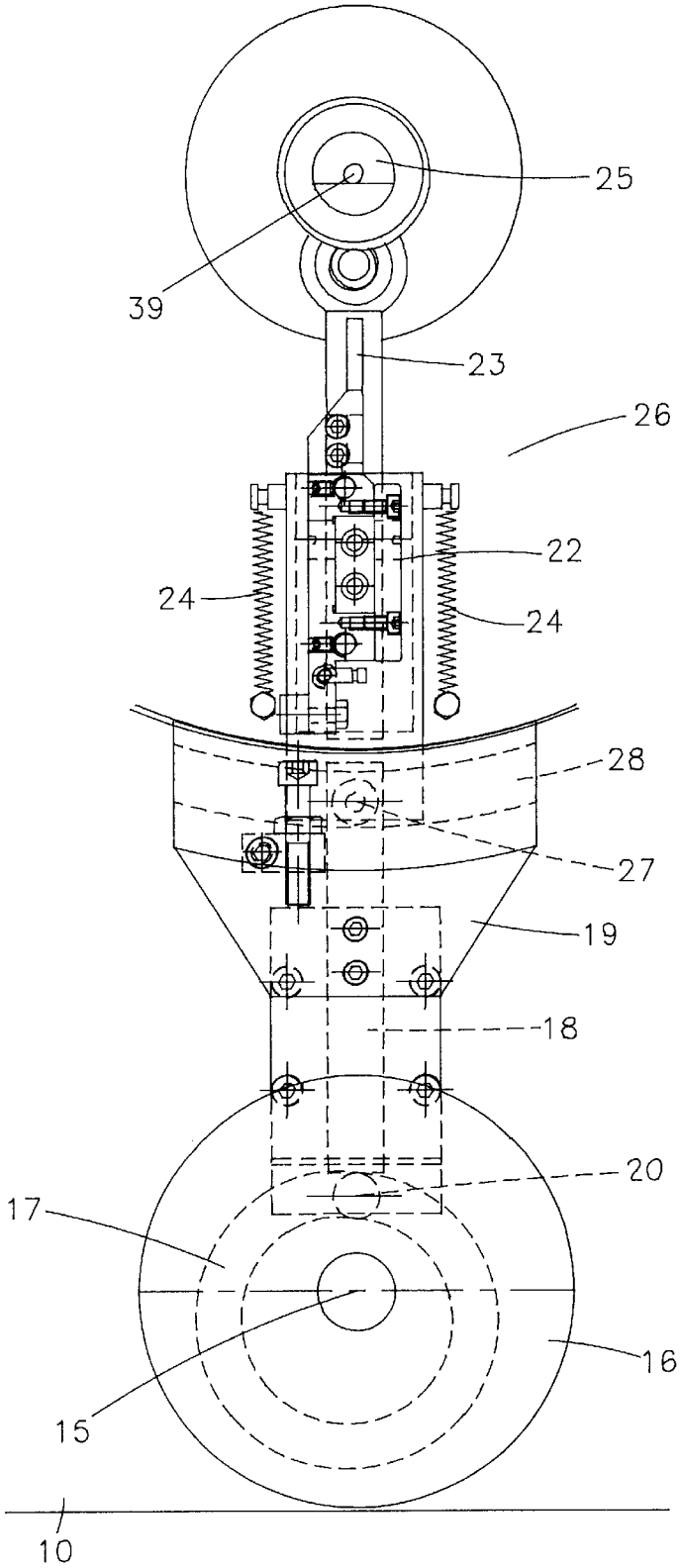
FIG. 4 is the front view of a single forming unit of the subject invention.
Figure 5:
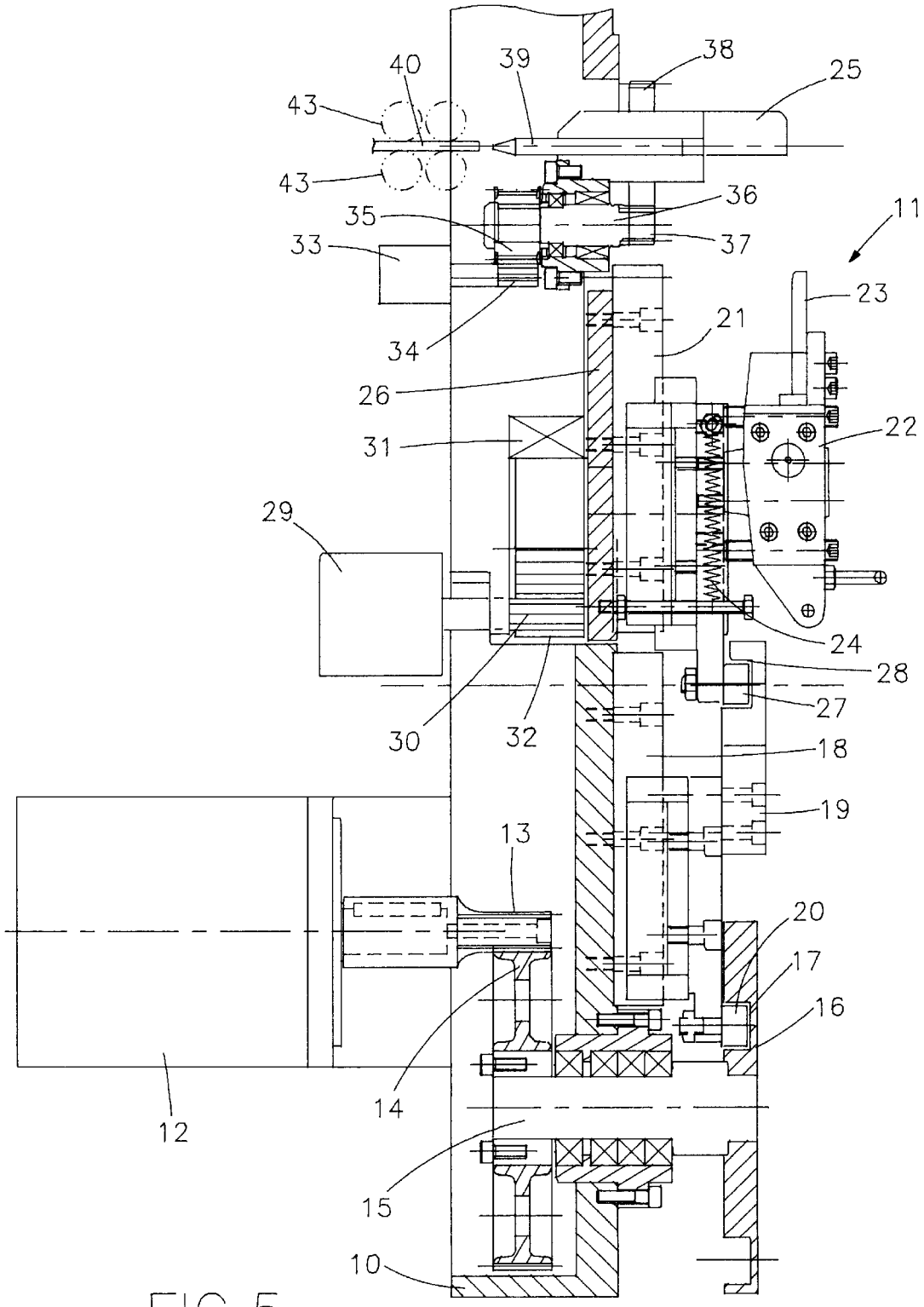
FIG. 5 is the side view of a single forming unit of the subject invention.
Figure 6:
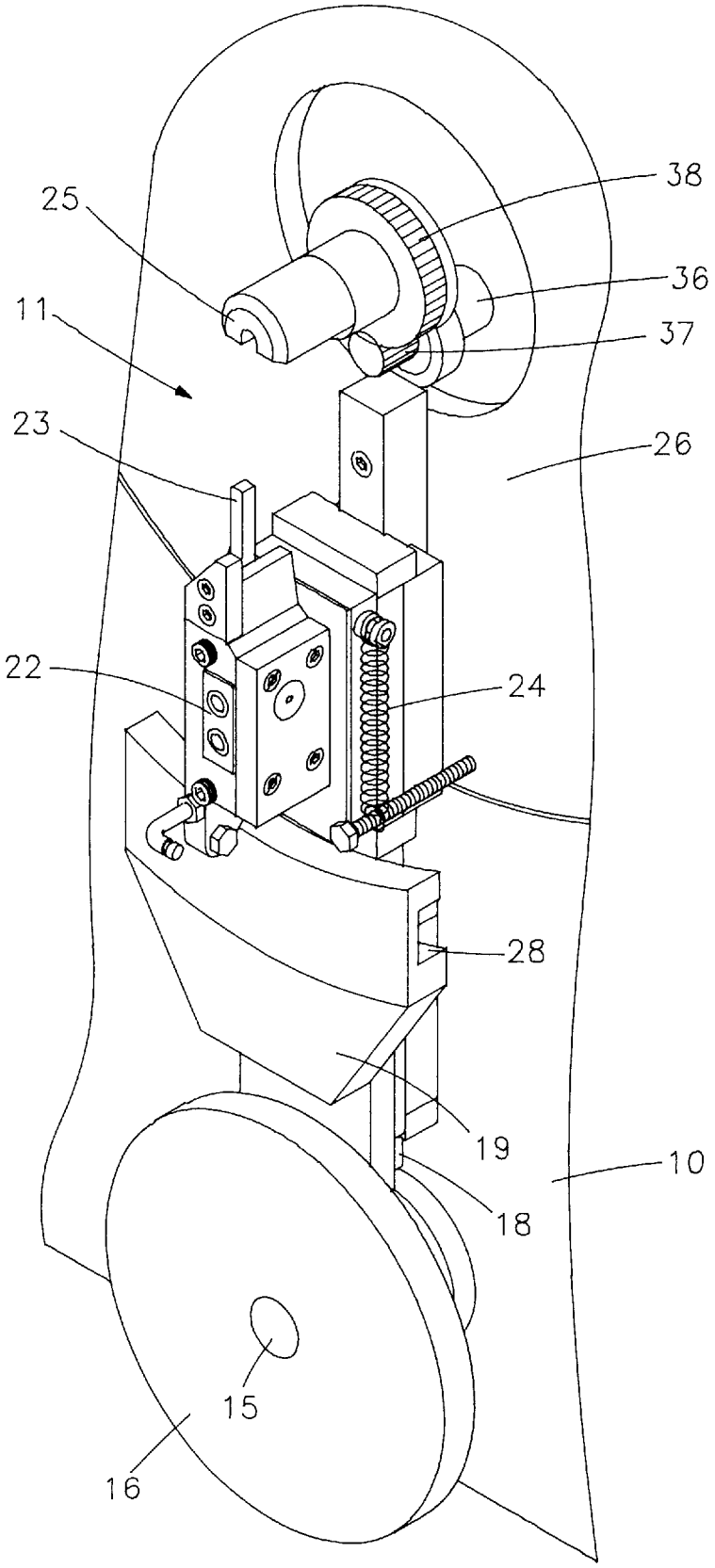
FIG. 6 is the perspective view of a single forming unit of the subject invention.

| | | | | | |
|---|---|---|---|---|---|
| 10 | machine body | 11 | forming unit | 12 | third servo motor |
| 13 | transmission gear | 14 | transmission gear | 15 | transmission shaft |
| 16 | cam | 17 | cam groove | 18 | first rail |
| 19 | transmission unit | 20 | first roller | 21 | second rail |
| 22 | cutter unit | 23 | forming cutter | 24 | reset spring |
| 25 | rotating spindle | 26 | rotating unit | 27 | second roller |
| 28 | groove | 29 | first servo motor | 30 | driving wheel |
| 31 | driven wheel | 32 | driving belt | 33 | second servo motor |
| 34 | transmission gear | 35 | transmission gear | 36 | transmission shaft |
| 37 | transmission gear | 38 | transmission gear | 39 | material feeding tube |
| 40 | wire material | 41 | moving arm | 42 | driven roller |
| 43 | feeding roller | | | | |
| 10a | machine body | 11a | forming unit | 12a | cam |
| 13a | moving arm | 14a | roller | 15a | linked lever |
| 16a | cutter unit | 17a | forming cutter | 18a | rotating spindle |

DETAILED DESCRIPTION OF PREFERRED EMBODIMENT

Referring to FIGS. 3, 4, 5 and 6, the subject invention relates to providing a type of automatic cutter rotating mechanism for wire forming machine, wherein, on the machine body 10 of said wire forming machine is fitted a rotating spindle 25 that protrudes to the front; inside said rotating spindle 25 is a material feeding tube 39; on the circumference of the rotating spindle 25 at the front of said machine body 10 is a round rotating unit 26; said rotating unit 26 can be rotated freely in all angles (360 degrees); on the rear of the machine body is fixed a first servo motor 29; at the axis of said first servo motor 29 is fixed a driving wheel 30; on the rear of the rotating unit 26 is fixed a driven wheel 31; the driving wheel 30 and the driven wheel 31 is connected by a driving belt 32; when the first servo motor 29 rotates, the driving force can be transmitted from the driving wheel 30 to the driven wheel 31, the driving belt 32 and such transmission mechanism to drive the rotating unit 26 to rotate an appropriate angle.

On the rear of the machine body 10 is fixed a second servo motor 33; said second servo motor 33 is connected via transmission gears 34 and 35 to a transmission shaft 36; said transmission shaft 36 is fitted onto the machine body 10; the other end of the transmission shaft 36 is connected via transmission gears 37 and 38 to the rotating spindle 25; when the second servo motor 33 rotates, the driving force is transmitted via the transmission gears 34 and 35, the transmission shaft 36, the transmission gears 37 and 38, and such transmission mechanism to drive the rotating spindle 25 to rotate.

On the machine body 10 and the rotating unit 26 are several sets (eight sets) of forming units 11; each of said forming units 11 has a third servo motor 12 that is fitted on the rear of the machine body 10; the first servo motor 12 is connected via transmission gears 13 and 14 to a transmission shaft 15; said transmission shaft 15 is fitted on the machine body 10; the other end of the transmission shaft 15 is fixed with a cam 16; on the rear of the cam 16 is a cam groove 17; on the front of the machine body is fixed a first rail 18; the sliding on the first rail 18 is coordinated by a transmission unit 19; the transmission unit 19 can be guided by the first rail 18 to move up and down; on the front of the transmission unit 19 is fixed a first roller 20; the first roller 20 is fitted inside the cam groove 17 of the cam; when the third servo motor 12 rotates, the driving force is transmitted via transmission gears 13 and 14, the transmission shaft 15 and such transmission mechanism to drive the cam 16 to rotate; when the cam 16 rotates, the first roller 20 will move up and down along the curve of the cam groove 17.

Each of said forming units 11 has a second rail 21; said second rail 21 is fitted on the front of the rotation unit 26; the second rail 21 is coordinated by a cutter unit 22; on the cutter unit 22 is fixed a forming cutter 23; below the cutter unit 22 is fixed a second roller 27; said second roller 27 is located in the arched groove 28 on the rear of the transmission unit 19; when the first cam 16 rotates, it drives the first roller 20 to move up and down, then the first roller 20 will drive the transmission unit 19 to move up and down; the transmission unit 19 then drives the second roller via the groove 28, and the cutter unit 22 and the forming cutter 23 are driven to move up and down. On the transmission unit 26 are two reset springs 24; the ends of said two reset springs 24 are fixed to the rotation unit 26, while the other ends are connected to the cutter unit 22 to pull the cutter unit 22 to reset to its original position; by said configuration, the automatic cutter rotating mechanism for the wire forming machine is constituted.

The wire material 40 to be processed is delivered by the wire feeding device of feeding roller 43 at the rear of the rotating spindle 25, and fed in from the rear of the material supplying tube 39, then delivered out from the front of the material supplying tube 39; and the second servo motor 33 drives the rotating spindle 25 to adjust to an appropriate angle; then, the third servo motor 12 drives the forming cutter 23 to move up and down, so that the wire material 40 delivered from the rotating spindle 25 is pushed by the forming cutter 23, thus is bent and formed to produce springs or other parts. The subject invention relates mainly to a rotating unit 26 that can rotate freely at all angles (360 degrees); and the transmission unit 19 of each forming unit 11 and the cutter unit 22 are connected by a second roller 27 and the groove 28; the second roller 27 can move freely in the arched groove 28; whenever the second roller 27 is located at any point in the groove 28, the transmission unit 19 can drive said second roller 27 in the groove 28; therefore, even if the rotating unit 26 is not preset at a specified angle, the force of the transmission unit 19 will still transmit force to the cutter unit 22 and the forming cutter 23; in case of eight sets of forming units 11, even if the angle is beyond the specified 45 degrees, the forming operation will be processed if only the second roller 27 does not go out of the arched groove 28; so the wire forming machine is not restricted in its applications; furthermore, each cutter unit 22, forming cutter 23 and the second roller 27 that are fixed on the rotating unit 26 can be connected at random with any one set of the transmission unit 19 and groove 28, instead of one-to-one combinations, thus enabling more convenient operation; besides, the forming cutter 23 is reset by compulsory pulling method, so there will not be the occurrence of stuck wire material 40.

Figure 7:
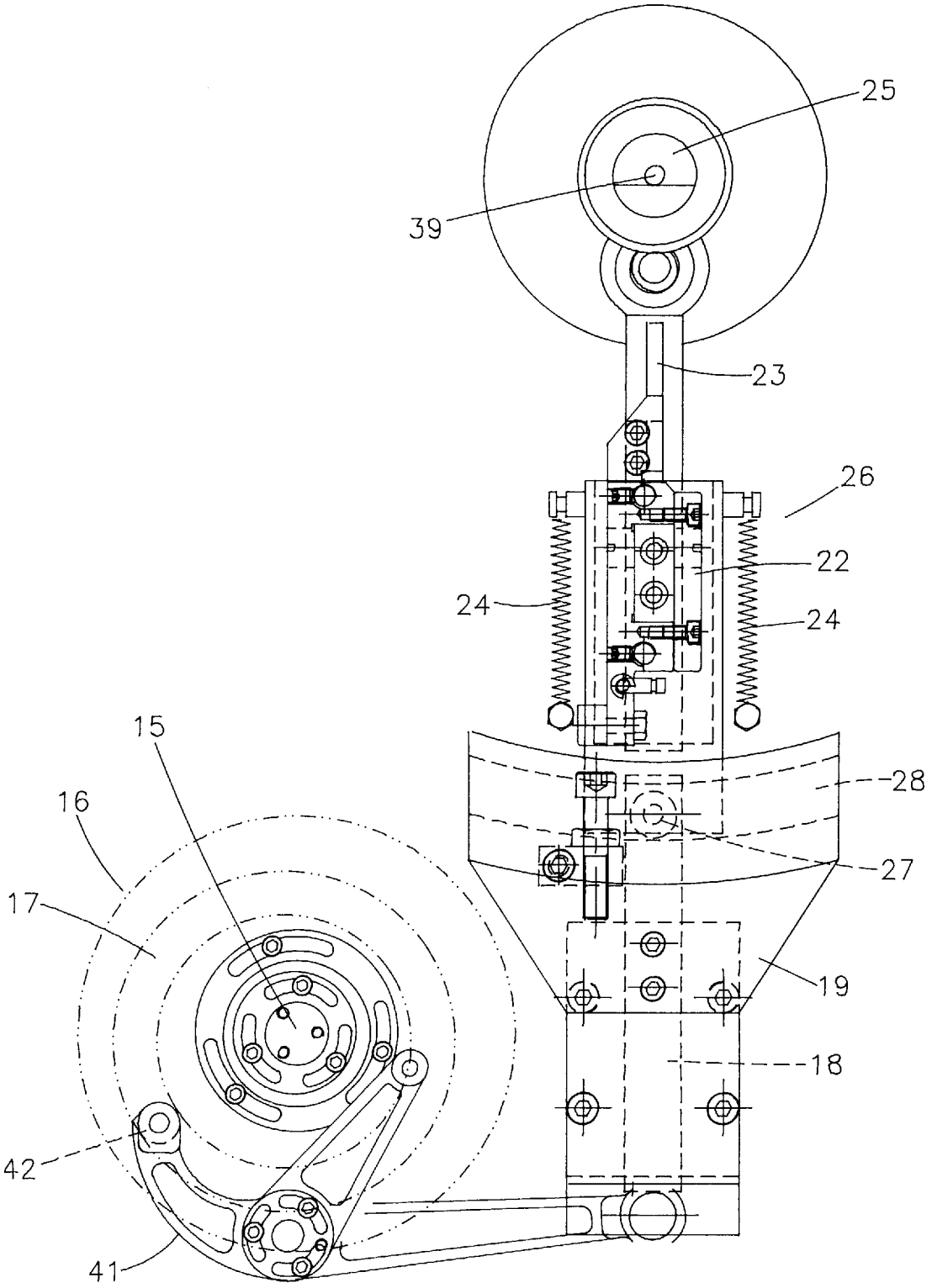
FIG. 7 is the front view of a single forming unit of another embodiment of the subject invention.

Furthermore, referring to FIG. 7 which is another embodiment of the subject invention, wherein, between the cam 16 and the transmission unit 19 is a moving arm 41; said moving arm 41 is fitted on one side of the transmission unit 19; one end of the moving arm 41 is joined to a driven roller 42; the driven roller 42 is fitted inside the cam groove 17 of the cam 16; when the cam 16 rotates, the driven roller 42 will move up and down along the working curve of the cam groove 17, to drive the transmission unit 19, connected to the other end of the moving arm 41, to move up and down.

Summing up, the subject invention is actually an unprecedented novelty product with improvement on the weaknesses in conventional types of wire forming machine which forming units operate within a restricted angle, and which applications are restricted; with its novelty and originality that will fully satisfy the requirements for the application for a patent right, this application is filed in accordance with the Patent Law to protect the subject inventor's rights and interests. Your favorable consideration should be appreciated.

It is hereby declared that the above description, covering merely the preferred embodiments of the subject invention, should not be based to restrict or limit the subject claim, and that all equivalent configurational variations deriving from the subject description with drawings and contents therein should reasonably be included in the subject claim.

I claim:

1. An adjustable wire forming system comprising:

(a) a machine body;

(b) an automatically driven rotating spindle coupled to said machine body for the axial advancement of a wire workpiece therethrough;

(c) a rotating unit coupled to said machine body in angularly displaceable manner about said rotating spindle;

(d) means coupled to said rotating unit for driving said angular displacement thereof; and, (e) a plurality of forming assemblies disposed about said rotating spindle, each of said forming assemblies including:

(1) a cam unit coupled in angularly displaceable manner to said machine body, said cam unit having a cam groove formed therein;

(2) a cutter unit displaceably coupled to said rotating unit and having formed thereon a roller member, said cutter unit having extending therefrom a workpiece engagement member;

(3) a transmission unit coupled to said cam unit for imparting to said cutter unit, responsive to said cam unit angular displacement, a radial displacement relative to said rotating spindle, said transmission unit having formed therein an arcuate groove extending a predetermined angular distance about said rotating spindle for adjustably receiving said cutter unit roller member, said transmission unit having formed thereon a cam roller member for engaging said cam groove of said cam unit; and, (4) means coupled to said cam unit for automatically driving said angular displacement thereof;

whereby said cutter unit is adjustable in angular orientation relative to said rotating spindle.

2. The adjustable wire forming system as recited in claim 1 wherein at least one of said forming assemblies includes a reset spring coupled to said cutter unit for resiliently biasing said cutter unit to a reset position relative to said rotating unit.

3. An adjustable wire forming system comprising:

(a) a machine body;

(b) an automatically driven rotating spindle coupled to said machine body for the axial advancement of a wire workpiece therethrough;

(c) a rotating unit coupled to said machine body in angularly displaceable manner about said rotating spindle;

(d) means coupled to said rotating unit for driving said angular displacement thereof; and, (e) a plurality of forming assemblies disposed about said rotating spindle, each of said forming assemblies including:

(1) a cam unit coupled in angularly displaceable manner to said machine body, said cam unit having a cam groove formed therein;

(2) a cutter unit displaceably coupled to said rotating unit and having formed thereon a roller member, said cutter unit having extending therefrom a workpiece engagement member;

(3) a transmission unit coupled to said cam unit for imparting to said cutter unit, responsive to said cam unit angular displacement, a radial displacement relative to said rotating spindle, said transmission unit having formed therein an arcuate groove extending a predetermined angular distance about said rotating spindle for adjustably receiving said cutter unit roller member;

(4) a pivotally displaceable transmission arm coupled to said cam and transmission units for transferring said cam unit angular displacement to said transmission unit, said transmission arm having formed thereon a driven roller engaging said cam groove; and, (5) means coupled to said cam unit for automatically driving said angular displacement thereof;

whereby said cutter unit is adjustable in angular orientation relative to said rotating spindle.

* * * * *